United States Patent [19]

Hornung

[11] 4,287,923

[45] Sep. 8, 1981

[54] SCREWING HEADS

[76] Inventor: Ewald Hornung, Forstweg 144, 3260 Rinteln 6, Fed. Rep. of Germany

[21] Appl. No.: 25,606

[22] Filed: Mar. 30, 1979

[30] Foreign Application Priority Data

Oct. 6, 1978 [DE] Fed. Rep. of Germany ..... 2843684

[51] Int. Cl.[3] ..... B25B 15/00

[52] U.S. Cl. ..... 81/429

[58] Field of Search ..... 145/50 R

[56] References Cited

U.S. PATENT DOCUMENTS

| | | | |
|---|---|---|---|
| 2,157,574 | 5/1939 | Siesel | 145/50 R |
| 2,339,210 | 1/1944 | Volz | 145/50 R |
| 2,351,996 | 6/1944 | Morgan | 145/50 R |
| 2,461,491 | 2/1949 | Booth | 145/50 R |
| 2,472,659 | 6/1949 | Greer | 145/50 R |
| 2,491,325 | 12/1949 | McVey | 145/50 R |

*Primary Examiner*—Othell M. Simpson
*Assistant Examiner*—J. T. Zatarga

[57] ABSTRACT

A power-driven screwing head for use with a hand held power drill comprises a shank which can be clamped in the chuck of the drill. A screwdriver bit held in the head and consisting of a shank part and a blade part forms part of a coupling, which when a predetermined depth of screw penetration has been attained, automatically interrupts transmission of torque from the shank to the screw.

7 Claims, 1 Drawing Figure

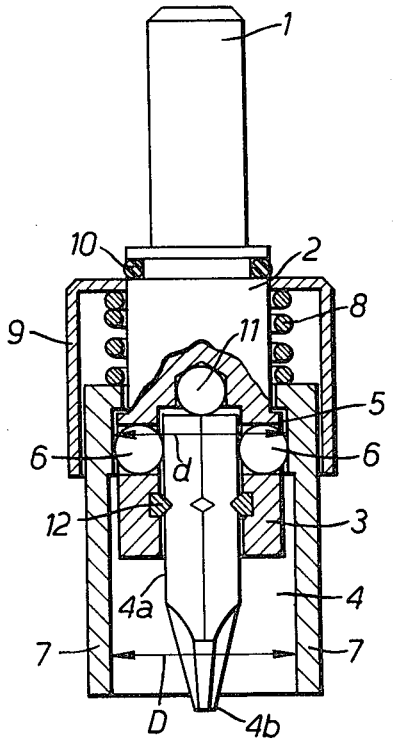
1
10
2
8
9
11
5
6
6
d
12
3
4a
4
7
7
D
4b

SCREWING HEADS

BACKGROUND OF THE INVENTION

1. Field of the Invention

The invention relates to a power-driven screwing head having means for disengaging the drive when a predetermined depth of screw penetration has been attained.

2. Description of the Prior Art

Screwing heads for screwing together wooden, chipboard and plasterboard panels have been proposed incorporating a coupling which is in the form of a slipping coupling, which does not or does only to an unsatisfactory degree permit screws to be screwed-in to a specific depth of penetration.

German Utility Model No. 7 624 784 discloses a screwdriver having an annular abutment face by which the screwing-in process is terminated when the screwheads have reached the desired depth of penetration into plasterboard panels. Regardless of whether it has a fixed or rotatable stop, damage to the screwheads when using a motor drive is inevitable with this screwdriver, since there is no coupling or clutch disengagement. Damage to screwheads must be avoided in interior construction work, since otherwise rust spots occur which are unsightly.

Devices of this type have also been proposed with releasable couplings and which, when the desired depth of penetration of the screw is attained, are automatically changed to the disengaged position. These devices are of complicated construction and are therefore also expensive, so that their use becomes practicable only for larger companies, but not for smaller installers or for the home handyman.

Accordingly, it is an object of the invention to provide a power-driven screwing head which is of simple design which is inexpensive to purchase and which is thus suitable for small industrial installers and for name applications, and which, while avoiding damage to screwheads and to the material into which the screws are to be screwed, reliably operates only to the depth to which it is desired that the screws penetrate.

SUMMARY OF THE INVENTION

According to the present invention, there is provided in a power-driven screwing head, shank means which can be clamped in the chuck of a drill, a screwdriver bit consisting of a shank part and a blade part, and coupling means which when a predetermined depth of screw penetration has been attained, automatically interrupts transmission of torque from the shank means to the screw, said screwdriver bit forming a part of said coupling means.

Since the screwdriver bit is itself envisaged as a part of the coupling, the screwing head has simplicity of construction can can therefore be manufactured to a price such that it becomes economically viable for the home handyman who is likely to use it only occasionally. Since the other parts of the coupling work virtually without wear and tear, when the screwdriver bit is changed the major part of the coupling is replaced, so that the effective life of the head is virtually unlimited.

BRIEF DESCRIPTION OF THE DRAWINGS

An embodiment of the power-driven screwing head according to the invention will now be described by way of example only with reference to the accompanying drawing, the sole FIGURE of which is a side view, partly in section, of the screwing head.

DESCRIPTION OF THE PREFERRED EMBODIMENT

In the drawing, reference numeral 1 denotes the shank which is to be clamped in the chuck of a power-operated handheld drill, such an an electric drill. Remote from the chuck, the shank 1 has an enlarged portion 2, which terminates in an annular end portion. This end portion defines a seat part 3 of circular cross-section for a screwdriver bit 4.

The screwdriver bit 4 consists of a shank part 4*a* and a blade part 4*b*. The shank part 4*a* takes the form of a polygonal cylinder, in other words of a cylinder the cross-section of which is a polygon. In the case of the embodiment shown in the drawing, the cross-section is a regular hexagon, although the invention is by no means confined to this embodiment. The internal diameter of the seat part 3 corresponds in this case to the width across the corners of the hexagonal shank part 4*a* of the screwdriver bit 4. The blade part 4*b* may be a cruciform blade or a chisel-shaped blade, according to whether it is to be used for screwing in cross-slotted screws or straight-slotted screws. Of course, the blade may also be multi-edged, for screwing in socketed head screws. In the case of the embodiment illustrated, the blade part 4*b* is a cruciform blade.

Provided in the seat part 3 are radially extending bores 5 in which locking balls 6 are movably disposed. The number of these locking balls 6 may correspond to the number of plane faces of the shank part 4*a*, but it may also be smaller than the number of these plane faces.

The seat part 3 is enclosed by a casing in the form of a sleeve 7 which is axially biased by means of a spring 8. By means of the spring biased sleeve 7, the locking balls 6 can be moved into a locking position or released position, in which they are, respectively, engaged with the plane surfaces of the shank part 4*a* of the screwdriver bit 4 or are disengaged therefrom. The length of the sleeve 7 is adapted to suit the depth to which the screw is to penetrate.

In its upper part, the sleeve 7 has an inside diameter d, this portion being adjacent to a portion of which the inside diameter D widens out, and into which the locking balls 6 can move in the released position.

One end of the spring 8 is braced against one end face of the sleeve 7 while its other end is braced against a cup-shaped member 9 which surrounds the sleeve 7. This member 9 is secured in one direction against axial movement along the shank 1, in the embodiment illustrated, this being effected by a circlip 10 which is applied against a collar 1*a* on the shank 1 and against the bottom of the cup-shaped member 9. By virtue of the shape of the member 9, the ingress of dirt into the head, and the consequent damage which this could cause, is prevented.

Located in the seat part 3 is a thrust bearing against which the shank part 4*a* of the screwdriver bit 4 bears. In the drawing, the thrust bearing is formed by a ball 11 which reduces to a tolerable level the friction forces occurring during the screwing and disengaging processes.

The screwdriver bit 4 is secured in the seat part 3 by means of an annular spring 12 so that it cannot fall out. To prevent the locking balls 6 from falling out when the screwdriver bit 4 is being replaced, they are retained by abutments which are not shown in the drawing. These abutments may expediently be formed by tapers of the inner ends of the bores 5.

The length of the sleeve 7 is variable by adding extension pieces of different lengths so that the head can be adjusted for different depths to which the heads of the screws may penetrate. These extension pieces are not shown in the drawings, but may comprise sleeves each of which can be detachably connected to the sleeve 7. It is convenient thereby to provide a screwed joint although of course other types of connection may be used.

The sleeve 7, the locking balls 6 housed in the seat part 3, and the shank part 4*a* of the screwdriver bit 4 together form a separable coupling which, upon a predetermined depth of penetration of the screw being attained, automatically prevents the transmission of the torque from the shank 1 to the screw. What is essential thereby is that the shank part 4*a* of the screwdriver bit 4 is itself a part of this coupling, so that by changing the worn out screwdriver bit 4, an essential part of the coupling is at the same time also renewed, which has a wear-diminishing effect on the coupling as a whole. Since the other parts of this coupling are scarcely subject to wear and tear, exchanging the screwdriver bit 4 virtually provides a new coupling.

The mode of action of the power-driven screwing head described is as follows:

Assuming it is desired to screw into a plasterboard panel, a screw which has a cruciform slot, then the blade part 4*b* of the screwdriver bit 4 is inserted into the cruciform slot in this screw. Next, the drill is operated and the front end face of the sleeve is pressed against the plasterboard panel so that the screw penetrates the panel. By reason of the pressure exerted by the operator on the drill the sleeve 7 moves upwards against the force of the spring 8, in other words into the cup-shaped member 9. The locking balls 6 are located thereby in the locking position, so that there is a force-locking connection between the seating part 3 and the shank part 4*a* of the screwdriver bit 4, via the locking balls 6.

Once the screw has reached the desired depth of penetration, the locking balls 6, in consequence of the extreme position of the sleeve 7 (topmost dead centre position in the cup-shaped abutment member 9), are able to move into the portion of the sleeve 7 which is of widened-out inside diameter D, so that the force-locking connection between the locking balls 6 and the shank part 4*a* of the screwdriver bit 4 is broken. Thus transmission of the rotary movement from the shank 1 to the screw is interrupted, so that despite further rotation of the seating part 3, further screwing-in becomes impossible.

When the drill is lifted away so that there is no longer any contact between the front end face of the sleeve 7 and the panel, the spring 8 moves the sleeve 7 back again into the locking position shown in the drawing, in which the force-locking connection between the locking balls 6 on the one hand and the shank part 4*a* of the screwdriver bit 4 on the other is restored.

The screwing-in process can then be repeated accordingly, as desired.

What is claimed is:

1. A screwing head, comprising shank means adapted to be rotatably driven, said shank means having a longitudinal axis and said shank means having an end portion of annular cross-section, said end portion of annular cross-section defining a seat, a screwdriver bit comprising a shank part, said shank part being located in said seat, locking members for releasably locking the shank part of the screwdriver bit within the seat so that the screwdriver bit can be rotated by the shank means, said locking members being mounted in the end portion of annular cross-section for movement transversely of the longitudinal axis of the shank means between radially inner positions in which the locking members lock the shank part of the screwdriver bit for rotation with the shank means, and radially outer positions in which the locking members release the shank part of the screwdriver bit to permit relative rotation between the shank means and the shank part of the screwdriver bit, an annular casing mounted on the shank means for longitudinal movement relative thereto, said casing surrounding the annular end portion of the shank means and having an internal surface, said internal surface comprising a portion of relatively small internal diameter and a portion of relatively larger internal diameter, said casing being movable longitudinally relative to the shank means from a locking position in which the small internal diameter portion holds the locking members in the radially inner positions and a release position in which the locking members can move radially outwardly into the larger internal diameter portion, and spring means biasing the casing into its locking position, the casing being movable from its locking to its release position by engagement with a workpiece upon a predetermined depth of screwing being attained.

2. A screwing head according to claim 1, further comprising a cup-shaped abutment surrounding the casing, said spring means being a helical spring which is interposed between the abutment and the casing.

3. A screwing head according to claim 2, further comprising means securing the cup-shaped abutment on the shank means against longitudinal movement in one direction.

4. A screwing head according to claim 1, further comprising thrust bearing means in said seat, the shank part of the screwdriver bit thrusting against said thrust bearing means.

5. A screwing head according to claim 4, wherein the thrust bearing means comprises a ball.

6. A screwing head according to claim 1, further comprising means for securing the screwdriver bit within the seat to prevent the bit from falling out of the seat.

7. A screwing head according to claim 1, wherein the shank part of the screwdriver bit is of polygonal cross-section.

* * * * *

UNITED STATES PATENT AND TRADEMARK OFFICE

CERTIFICATE OF CORRECTION

PATENT NO. : 4,287,923

DATED : September 8, 1981

INVENTOR(S) : Ewald Hornung

It is certified that error appears in the above-identified patent and that said Letters Patent are hereby corrected as shown below:

Please correct the above identified patent by adding in the heading: --[73] Assignee: Feinwerkbau Helfer & Co. KG, Federal Rep. of Germany--.

Signed and Sealed this

*Twelfth* Day of *January 1982*

[SEAL]

*Attest:*

GERALD J. MOSSINGHOFF

*Attesting Officer*

*Commissioner of Patents and Trademarks*

REEXAMINATION CERTIFICATE (1046th)

United States Patent [19]

Hornung

[11] B1 4,287,923

[45] Certificate Issued Apr. 25, 1989

[54] SCREWING HEADS

[75] Inventor: Ewald Hornung, Forstweg, Fed. Rep. of Germany

[73] Assignee: Feinwerkhau Helfer & Co. KG, Rinteln, Fed. Rep. of Germany

Reexamination Request:
No. 90/001,373, Nov. 12, 1987

Reexamination Certificate for:

| | |
|---|---|
| Patent No.: | **4,287,923** |
| Issued: | **Sep. 8, 1981** |
| Appl. No.: | **25,606** |
| Filed: | **Mar. 30, 1979** |

Certificate of Correction issued Jan. 12, 1982.

[30] Foreign Application Priority Data

Oct. 6, 1978 [DE] Fed. Rep. of Germany ..... 2843684

[51] Int. Cl.[4] ..... B25B 15/00; B23B 31/22

[52] U.S. Cl. ..... 81/429; 279/75; 279/30

[58] Field of Search ..... 81/429, 451; 279/75, 279/30; 464/35, 36; 192/56 R

[56] References Cited

U.S. PATENT DOCUMENTS

| | | | |
|---|---|---|---|
| Re. 13,274 | 5/1914 | Lindberg | 279/75 |
| 974,239 | 11/1910 | Dalton . | |
| 1,124,981 | 1/1915 | Weaver | 279/75 |
| 1,882,913 | 10/1932 | Richey | 81/429 |
| 2,491,325 | 12/1949 | McVey | 64/29 |
| 2,684,491 | 7/1954 | Roddick | 279/75 |
| 2,736,561 | 2/1956 | Hansen | 279/75 |
| 2,790,471 | 4/1957 | Graybill | 81/429 |
| 3,005,325 | 10/1961 | Eckman | 464/35 |
| 3,115,230 | 12/1963 | Creighton et al. | 192/56 |
| 3,187,865 | 6/1965 | Blachowski | 81/451 |
| 3,194,370 | 7/1965 | Bennett | 192/56 |
| 3,436,086 | 4/1969 | Glenzer | 279/30 |
| 3,527,273 | 9/1970 | Falter | 81/429 |
| 3,552,147 | 1/1971 | Johansson et al. | 279/30 |
| 3,583,715 | 6/1971 | Jahrl | 279/75 |
| 3,767,218 | 10/1973 | Linthicum et al. | 279/75 |
| 3,787,136 | 1/1974 | Steiner | 192/56 |
| 4,237,946 | 12/1980 | Leitner | 81/429 |

*Primary Examiner*—Debra S. Meislin

[57] ABSTRACT

A power-driven screwing head for use with a hand held power drill comprises a shank which can be clamped in the chuck of the drill. A screwdriver bit held in the head and consisting of a shank part and a blade part forms part of a coupling, which when a predetermined depth of screw penetration has been attained, automatically interrupts transmission of torque from the shank to the screw.

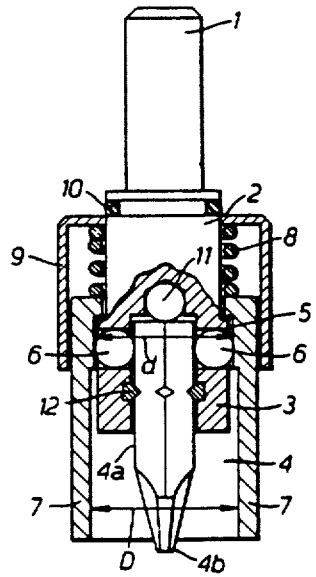

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *